United States Patent [19]

Long

[11] Patent Number: 4,919,638

[45] Date of Patent: Apr. 24, 1990

[54] REMOTELY CONTROLLED TOY FOR CAPTURING APPARITIONS

[76] Inventor: Jeffrey L. Long, 30 Celeste Ave., Holbrook, N.Y. 11741

[21] Appl. No.: 367,762

[22] Filed: Jun. 19, 1989

[51] Int. Cl.[5] ..... A63H 33/00

[52] U.S. Cl. ..... 446/490; 446/491; 220/262

[58] Field of Search ..... 446/491, 28, 454, 487, 446/490, 489, 31, 361, 310, 486; 220/262, 263, 264; 272/27 N; 43/61, 63, 110

[56] References Cited

U.S. PATENT DOCUMENTS

| | | | |
|---|---|---|---|
| 308,634 | 12/1884 | Seinecke | 220/264 X |
| 2,054,145 | 9/1936 | Tandy | 220/264 X |
| 4,661,080 | 4/1987 | Goldstêin et al. | 446/4 |

*Primary Examiner*—Mickey Yu

*Attorney, Agent, or Firm*—Michael I. Kroll

[57] ABSTRACT

A remotely controlled toy for capturing apparitions is disclosed. The toy has a containment box with an opened position and a closed position. An activating box is disposed a distance from the containment box. A cable connects the containment box to the activating box so that the containment box can change from the closed position to the opened position when the activating box is operated from a safe distance.

13 Claims, 4 Drawing Sheets

REMOTELY CONTROLLED TOY FOR CAPTURING APPARITIONS

BACKGROUND OF THE INVENTION

1. Field of the Invention:

The present invention relates to a containment device.

More particularly, the present invention relates to a remotely controlled toy for capturing apparitions.

2. Description of the Prior Art:

The U.S. Pat. No. 3,186,251 to Quarfoot includes control means disposed at a remote location, a rotatable member disposed at an accessible location spaced apart from the remote location; and flexible shaft means connected between the control means and the rotatable member.

The U.S. Pat. No. 2,102,775 to Woodhead teaches an enclosed type of automobile which has at one side of its rear the concealed gas tank from which projects to the exterior of the automobile the filling neck which is closed by a filling cap. An operating cable extends through a suitable flexible conduit to the instrument panel or other supporting element in the interior of the automobile where the cable is operatively connected to the control or operating knob which is in the interior of the automobile for protection against tampering by unauthorized persons.

The U.S. Pat. No. 308,634 to Seinecke teaches a push piece occupying an axial position within the handle of the implement. The handle is attached to a plate adapted to be clamped to the ends of the boxes and near the upper edges of the boxes. The opposite ends of the boxes have fastened to them another plate that is connected to the first one by a screw-threaded rod occupying an interval space between the inner sides of the boxes. The plate to which the handle is attached carries a pair of rock-shafts whose inner ends are bent to form cranks that are jointed to links or lifters. The links are coupled to the hinged lids of the boxes. The outer ends of the rock-shafts have curved arms that engage either with an eye at the bottom of the push-piece or with an eye formed on a rod attached to the push-piece. The push-piece is maintained in its normal or elevated position by a coiled spring fitted within the handle.

The U.S. Pat. No. 2,059,821 to Spitalny teaches a vanity case having latch means for expeditiously opening and closing the hinged portions making up the case.

The vanity case consists of at least two hinged portions, one of the portions being provided with a member of the approximate length of the case to serve as a closure fastener so that tilting the member will free the other portion of the case for ready and easy access to the interior of the case.

The U.S. Pat. No. 717,717 to Rowe teaches a box that has rounded edges and has an opening in one face. A partition is located near one end and held in place by a screw connecting the bottom of the box with the lug, extending from the partition. On the face of the partition, next to the end of the box, is supported a slide by a screw, located in the lengthwise slot and connected to the partition. One end of the slide has a hooked portion and the other end has a rounded section. The rounded section of the slide is located in an opening in one edge of the box.

Numerous innovations for remotely controlled toys have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a remotely controlled toy.

More particularly, it is an object of the present invention to provide a remotely controlled toy for capturing apparitions, that is safe and simple to use.

In keeping with these objects, and with others which will become apparent hereinafter, one feature of the present invention resides, briefly stated, in a remotely controlled toy for capturing apparitions, that contains containment means having an opened position and a closed position, and means for connecting the containment means to the activating means wherein activating means are disposed a distance from the containment means.

When the remotely controlled toy for capturing apparitions is designed in accordance with the present invention, the containment means can change from the closed position to the opened position when the activating means is operated from a safe distance.

In accordance with another feature of the present invention, the containment means include a containment box.

Another feature of the present invention is that the containment box has a top that is a pair of pivotally mounted doors.

Yet another feature of the present invention is that the activating means include a step box.

Still another feature of the present invention is that the step box has a top that is a pivotally mounted plate.

Yet still another feature of the present invention is that the connecting means is a cable.

Still yet another feature of the present invention is that the cable has a fixed outer part and a movable inner part disposed internal to and concentrically with the fixed outer part.

Another feature of the present invention is that it further comprises a handle rigidly attached to the containment box.

Yet another feature of the present invention is that it further comprises a release disposed on the handle of the containment box and which keeps the containment box in the closed position.

Still another feature of the present invention is that the cable has a first end and a second end and the first end passes through the handle in such a matter that the outer part of the first end of the cable remains stationary within the handle while the inner part of the first end of the cable is connected to the release that causes the containment box to change from the closed position to the opened position when the inner part of the first end of the cable slides away from the pair of doors.

Yet still another feature of the present invention is that it further comprises a spring disposed around the inner part of the first end of the cable so that when the inner part of the first end of the cable is displaced the release will cause the containment box to obtain the opened position and when the inner part of the first end of the cable is released the spring will bias the release to the closed position of the containment box.

Still yet another feature of the present invention is that each of the doors of the containment box contain a cutout so that the containment box can be manually closed.

Another feature of the present invention is that the step box has a housing with a door that is pivotally mounted to the housing.

Yet another feature of the present invention is that the housing of the step box receives the second end of the cable in such a manner that the outer part of the second end of the cable is fixedly attached to the housing and the inner part of the cable is attached to the pivotally mounted plate.

Still another feature of the present invention is that it further comprises a spring disposed within the housing of the step box and is attached to the housing and the plate so as to bias the plate to a substantially horizontal position.

Yet still another feature of the present invention is that it further comprises a first hook and a second hook so that the toy can be carried on the user's belt by using the first hook while the cable is wrapped around the second hook for ease of transport.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
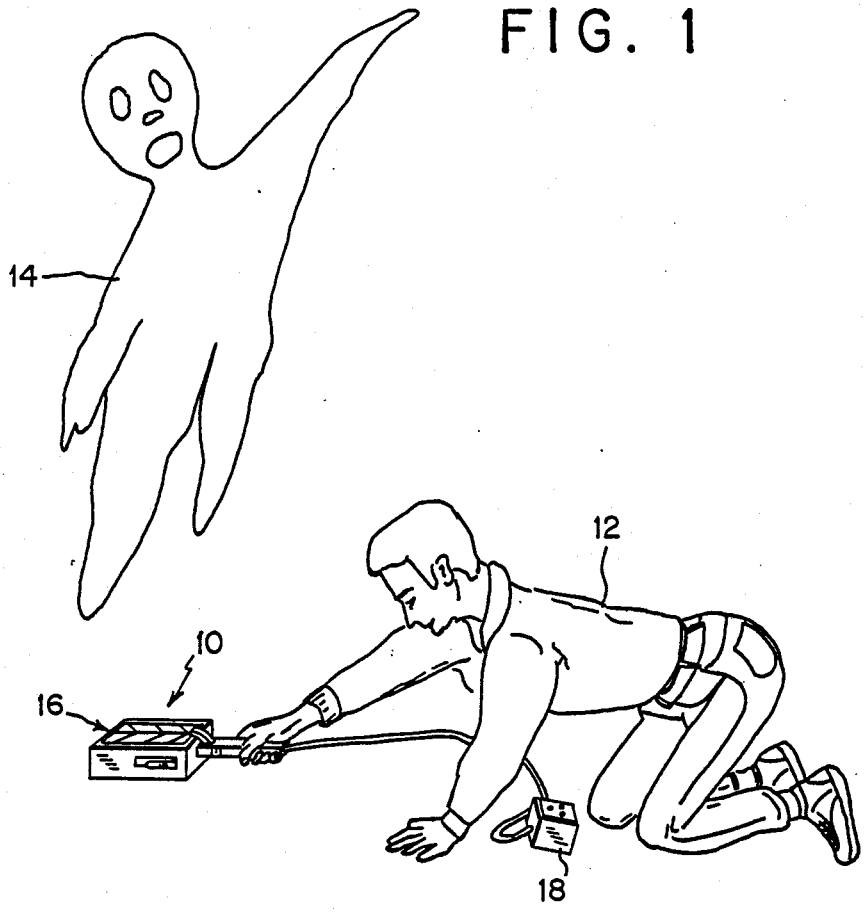
FIG. 1 is a view of the user positioning the present invention for capturing an apparition.

10 - a toy for remotely controlled toy for capturing apparitions
12 - a user of the remotely controlled toy for capturing apparitions
14 - an apparition
16 - a containment box of the remotely controlled toy for capturing apparitions
18 - a step box of the remotely controlled toy for capturing apparitions
20 - a foot of the user 12 using the remotely controlled toy for capturing apparitions
24 - an arrow
26 - a cable for connecting the containment box 16 to the step box 18
30 - a top portion of the containment box 16
31 - springs
38 - an articulated door of the top portion of the containment box 16
40 - an articulated door of the top portion 30 of the containment box 16
42 - a fixed end of the handle 46
43 - a notch on the articulated door 38
44 - a free end of the handle 46
45 - a notch on the articulated door 40
46 - a handle of the containment box 16
48 - a release of the containment box 16
49 - a clip for carrying the present invention on the belt of the user 12
50 - a plate being pivotally mounted to the step box 18
52 - a rod disposed in the step box 18
53 - a clip for carrying the connecting cable 26
54 - a movable inner part of the cable 26
55 - a fixed outer part of the cable 26
56 - a first end of the cable 26
57 - a second end of the cable 26
58 - an arrow
59 - a housing of the step box 18
60 - a spring disposed in the handle 46
61 - an elongated hollow portion of the handle 46
62 - a bracket in the step box 18
63 - a spring disposed in the step box 18
64 - an arrow
65 - an aperture in the step box 18
66 - an arrow
67 - a stop in the step box 18
68 - a pair of clips
70 - bolts securing the clips 68 to the plate 50
72 - nuts securing the bolts 70
74 - a first end of the spring 63
77 - a screw
78 - a nut
82 - a bottom of the housing 59
83 - a second end of the spring 63

DETAILED DESCRIPTION OF THE PREFERRED EMBODIMENT

Referring now to the FIG. 1, the remotely controlled toy for capturing apparitions of the present invention is shown generally at 10 in the closed position. The remotely controlled toy for capturing apparitions 10 is being properly positioned by a user 12 to capture an apparition 14.

In order to protect the user 12, from the apparition 14, a containment box 16 is activated by a remotely controlled step box 18.

Figure 2:
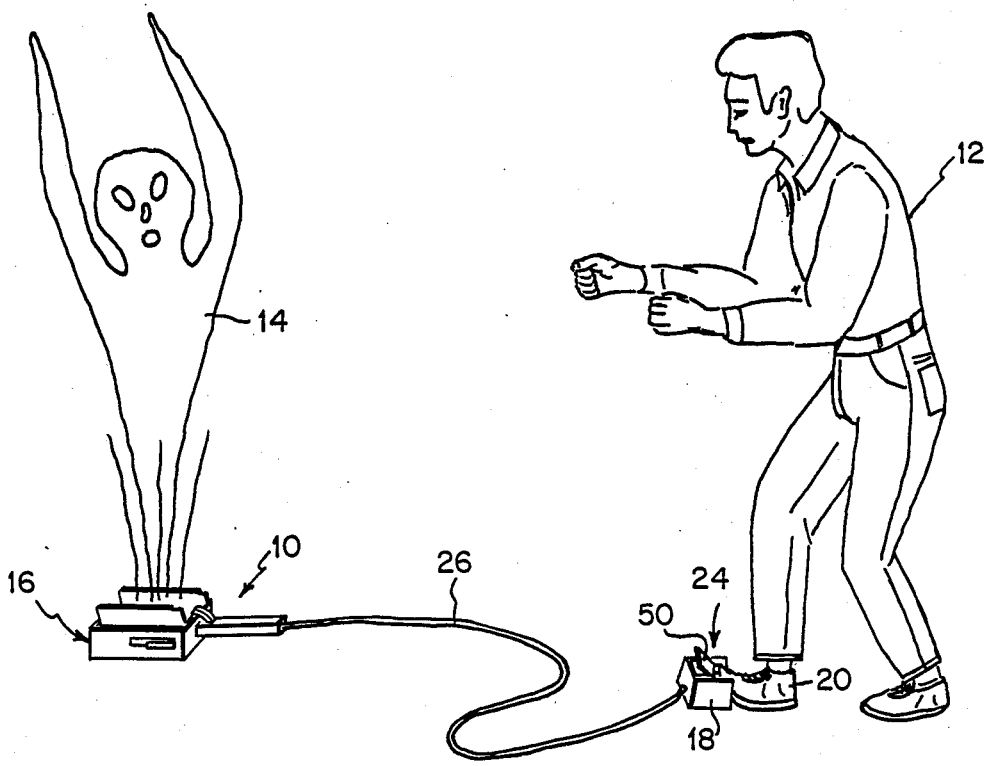
FIG. 2 is a view of the user stepping on the step box causing the containment box to open and capture the apparition shown in FIG. 1.

In FIG. 2, the containment box 16 is shown in the opened position. The opened position is achieved when a foot 20 of the user 12 steps on the plate 50 of the step box 18 in the direction of arrow 24.

A cable 26 connects the containment box 16 to the step box 18 so that the containment box 16 can be opened remotely.

When the containment box 16 is in the opened position, the apparition 14 is drawn into the containment box 16.

Figure 3:
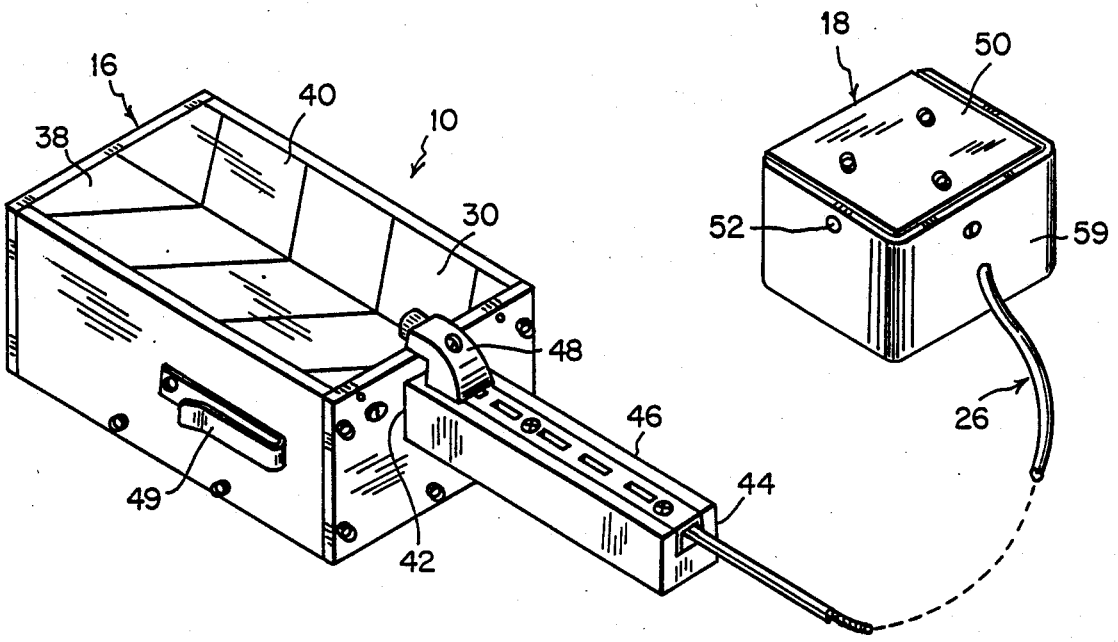
FIG. 3 is a perspective view of the present invention in the closed position.
Figure 4:
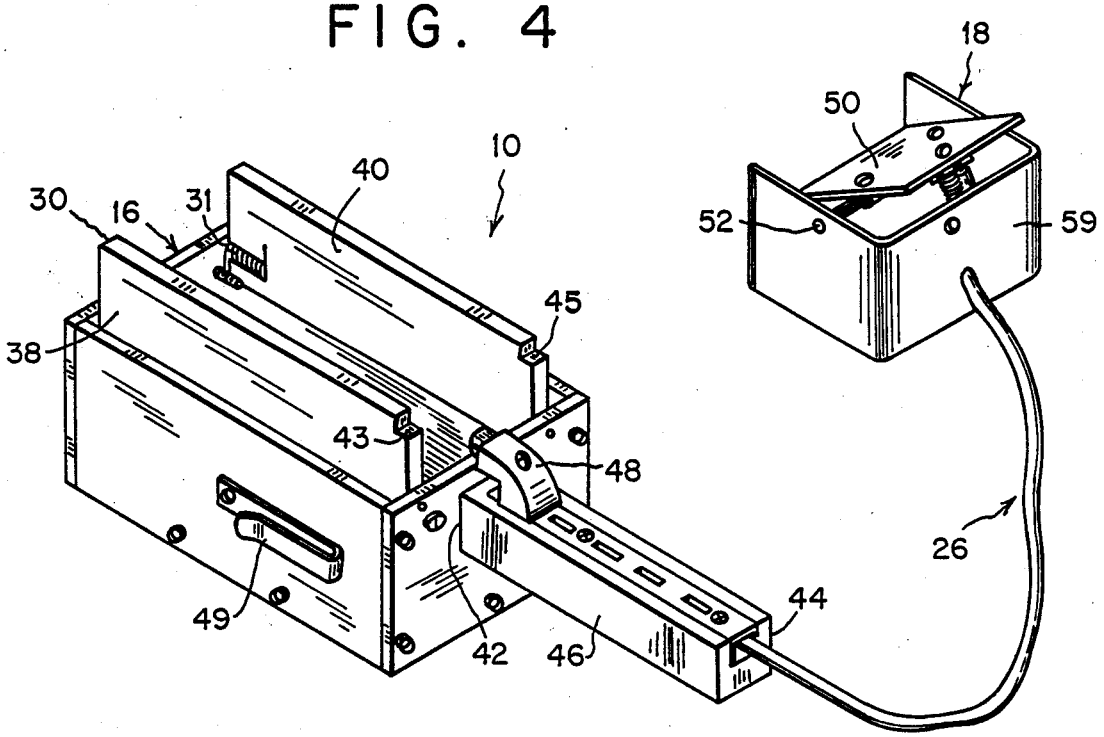
FIG. 4 is a perspective view of the present invention in the opened position.
Figure 6:
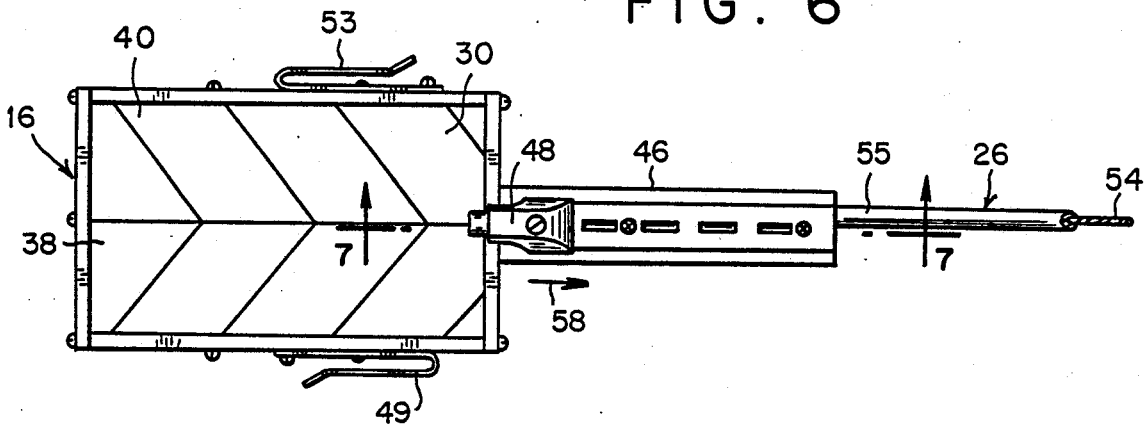
FIG. 6 is a plan view of the containment box of the present invention.

The external configuration of the containment box 16 and the step box 18 is shown in FIGS. 3, 4, and 6. In FIG. 3, the containment box 16 is shown in the closed position along with the step box 18. While in FIG. 4, the containment box 16 is shown in the opened position along with the step box 18.

The containment box 16 whose top portion 30 contains a pair of articulated doors 38 and 40 and have springs 31 biasing the articulated doors 38 and 40 to the opened position.

A notch 43 is provided on the articulated door 38 along with a notch 45 that is provided on the articulated door 40. The notches 43 and 45 assist in the initial closing of the articulated door 38 and the articulated door 40, respectively, with minimal to no movement of the release 48.

A handle 46 having a fixed end 42 and a free end 44 is connected to the containment box 16. A release 48 is located on the fixed end 42 of the handle 46 and can move in the direction of arrow 58.

A clip 49 is affixed to the containment box 16. The clip 49 allows the containment box 16 to be attached to the belt of the user 12 for ease in transport, as shown in FIGS. 5 and 6.

Figure 5:
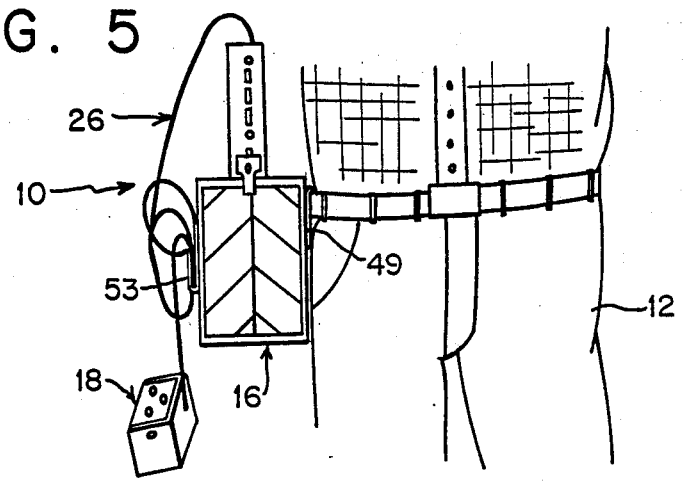
FIG. 5 is a view in which the present invention is hooked on to the belt of the user while the cable is wrapped around another hook for ease of transport.

Another clip 53 is affixed to the other side of the containment box 16 and carries the connecting cable 26, as shown in FIGS. 5 and 6.

The step box 18 has a top portion which is a pivotally mounted plate 50.

The internal configuration of the handle 46 of the containment box 16 and the step box 18 are shown in FIG. 7 through 10.

Figure 7:
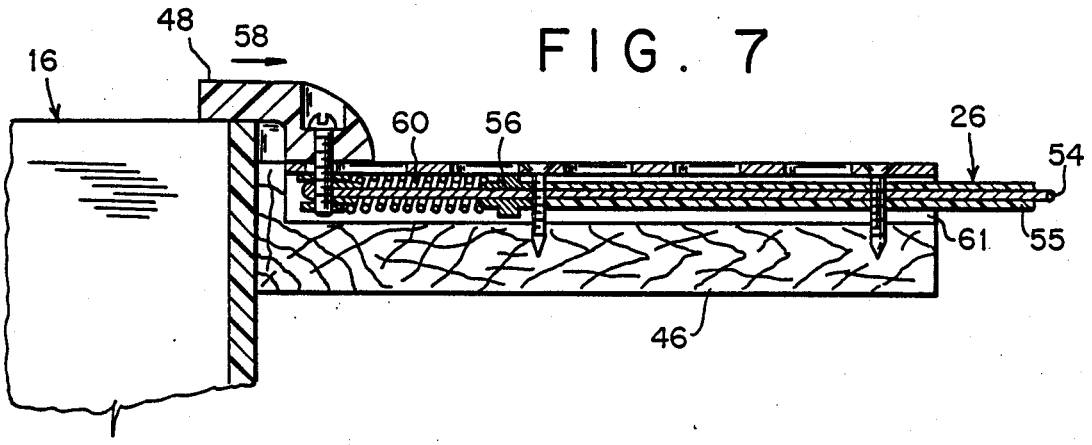
FIG. 7 is a cross-sectional view of the containment box taken along line 7—7 of FIG. 6.

As shown in FIG. 7, the handle 46 contains an elongated hollow portion 61. The cable 26 contains a fixed outer part 55 and a movable inner part 54 which is internally concentric to the fixed outer part 55.

The cable 26 has a first end 56 and a second end 57. The first end 56 passes through the hollow 61 in the handle 46. The outer part 55 of the first end 56 of the cable 26 remains stationary within the hollow 61 in the handle 46.

The inner part 54 of the first end 56 of the cable 26 is connected to the release 48.

The motion of the release 48 moving in the direction of arrow 58 allows the containment box 16 to achieve the opened position when the inner part 54 of the first end 56 of the cable 26 also moves in the direction of arrow 58.

A spring 60 is located around the inner part 54 of the first end 56 of the cable 26. When the inner part 54 of the first end 56 of the cable 26 is displaced in the direction of the arrow 58, the release 48 displaces and causes the pair of doors 38 and 40 to open and thus allowing the containment box 16 to achieve the opened position.

When the inner part 54 of the first end 56 of the cable 26 is released, the spring 60 biases the release 48 to the closed position of the containment box 16.

Figure 8:
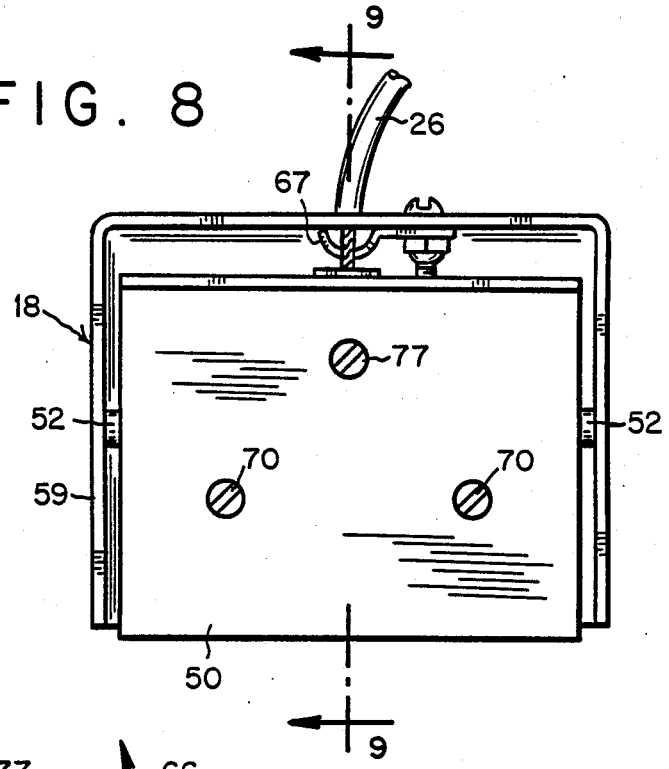
FIG. 8 is a plan view of the step box.
Figure 9:
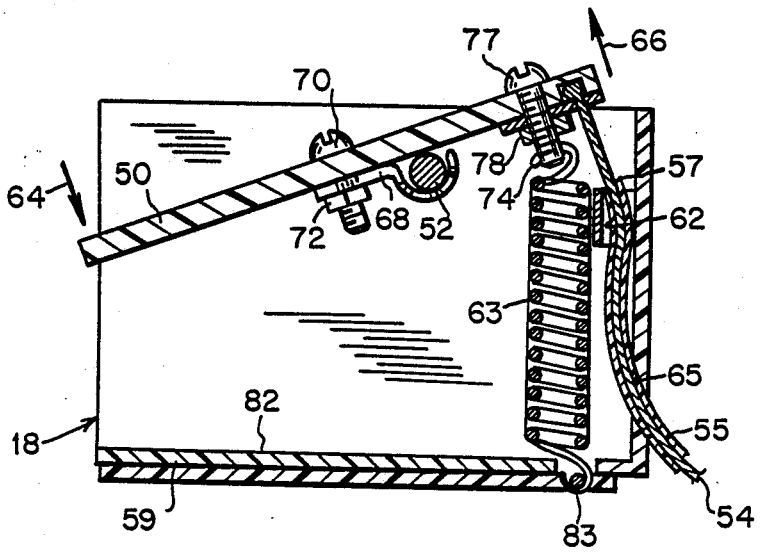
FIG. 9 is a cross-sectional view of the step box taken along line 9—9 of FIG. 8.
Figure 10:
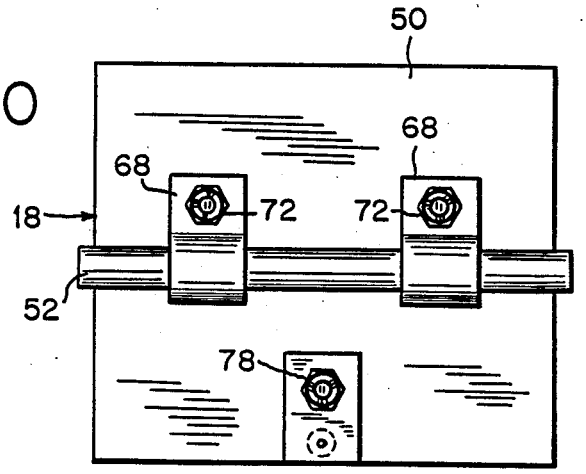
FIG. 10 is a plan view of the under side of the plate of the step box.

As shown in FIGS. 8 through 10, the step box 18 contains a plate 50 pivotally mounted by a rod 52 to housing 59.

The second end 57 of the cable 26 passes through an aperture 65 in the housing 59. The outer part 55 of the second end 57 of the cable 26 remains stationary on a bracket 62 in the step box 18.

The inner part 54 of the second end 57 of the cable 26 is connected to a stop 67 located integrally with the plate 50.

A spring 63, is located within the housing 59 and biases the plate 50 to the closed position. The spring 63 is attached to the housing 59 and the plate 50. The inner part 54 of the second end 57 of the cable 26 is displaced by the movement of the plate 50 moving in the direction of arrows 64 and 66.

A pair of clips 68 is attached with bolts 70 to the plate 50. The pair of clips 68 are secured with nuts 72 to the plate 50 while cradling the pivot rod 52.

The spring 63 has a first end 74 and a second end 83. The first end 74 of the spring 63 is attached to the plate 50 by use of a screw 77 and a nut 78. The second end 83 of the spring 63 is attached to the bottom 82 of the housing 59.

In operation, the user 12 carefully positions the containment box 16 under the apparition 14, with the doors 38 and 40 being kept in the closed position, by the release 48. The user 12 then steps back and uses his foot 20 to push down the plate 50 of the step box 18 in the direction of the arrow 24 and ultimately capturing the apparition 14.

When the plate 50 of the step box 18 is pivoted about the rod 52 in the direction of the arrows 64 and 66, the inner part 54 of the second end 57 of the cable 26 is displaced.

The plate 50 remains in the opened position until the foot 20 of the user 12 is removed and the spring 63 then returns the plate 50 to the closed position.

When the plate 50 of the step box 18 is pivoted about the rod 52 in the direction of the arrows 64 and 66, the inner part 54 of the first end 56 of the cable 26 is displaced. Since the inner part 54 of the first end 56 of the cable 26 is attached to the release 48, the release 48 will be displaced in the direction of the arrow 58 and allow the doors 38 and 40 to open until the foot 20 of the user 12 is removed from the plate 50 of the step box 18.

It will be understood that each of the elements described above, or two or more together, may also find a useful application in other types of constructions differing from the type described above.

While the invention has been illustrated and described as embodied in a remotely controlled toy for capturing apparitions, it is not intended to be limited to the details shown, since it will be understood that various omissions, modifications, substitutions and changes in the forms and details of the toy illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A remotely controlled toy for capturing apparitions, comprising:

(a) containment means having an opened position and a closed position, said containment means include a containment box, said containment box has a top that is a pair of pivotally mounted doors for providing said opened position and said closed position;

(b) activating means disposed a distance from said containment means, said activating means include a step box; and (c) means for connecting said containment means to said activating means so that 2. A toy as defined in claim 1, wherein said step box has a top that is a pivotally mounted plate.

3. A toy as defined in claim 2, wherein said connecting means is a cable.

4. A toy as defined in claim 3, wherein said cable has a fixed outer part and a movable inner part disposed internal to and concentrically with said fixed outer part.

5. A toy as defined in claim 4; further comprising a handle rigidly attached to said containment box.

6. A toy as defined in claim 5; further comprising a release disposed on said handle of said containment box and keeping said containment box in said closed position.

7. A toy as defined in claim 6, wherein said cable has a first end and a second end and said first end passes through said handle in such a matter that said outer part of said first end of said cable remaining stationary within said handle while said inner part of said first end of said cable being connected to said release which causes said containment box to change from said closed position to said opened position when said inner part of said first end of said cable slides away from said pair of doors.

8. A toy as defined in claim 7; further comprising a spring disposed around said inner part of said first end of said cable so that when said inner part of said first end of said cable is displaced said release will cause said containment box to obtain said opened position and when said inner part of said first end of said cable is released said spring will bias said release to said closed position of said containment box.

9. A toy as defined in claim 8, wherein each of said doors of said containment box contain a cutout so that said containment box can be manually closed.

10. A toy as defined in claim 9, wherein said step box has a housing with a door that is pivotally mounted to said housing.

11. A toy as defined in claim 10, wherein said housing of said step box receives said second end of said cable in such a manner that said outer part of said second end of said cable is fixedly attached to said housing and said inner part of said cable is attached to said pivotally mounted plate.

12. A toy as defined in claim 11; further comprising a spring disposed within said housing of said step box and being attached to said housing and said plate so as to bias said plate to a substantially horizontal position.

13. A toy as defined in claim 12; further comprising a first hook and a second hook so that the toy can be carried on the user's belt by using said first hook while said cable is wrapped around said second hook for ease of transport.

* * * * *